US005551699A

United States Patent [19]

Pavelich

[11] Patent Number: 5,551,699

[45] Date of Patent: Sep. 3, 1996

[54] HORSE RACING GAME

[76] Inventor: Dallas C. J. Pavelich, Box 278, Kenaston, Saskatchewan, Canada, S0G 2N0

[21] Appl. No.: 572,037

[22] Filed: Dec. 14, 1995

[51] Int. Cl.[6] ..... A63F 3/00

[52] U.S. Cl. ..... 273/246

[58] Field of Search ..... 273/243, 244, 273/246, 256, 259, 277, 278

[56] References Cited

U.S. PATENT DOCUMENTS

| | | | |
|---|---|---|---|
| 3,963,243 | 6/1976 | Contento | 273/246 |
| 4,082,289 | 4/1978 | Merritt | 273/246 |
| 4,624,463 | 11/1986 | Glennon | 273/246 |
| 4,890,843 | 1/1990 | Chauve | 273/246 |
| 4,917,386 | 4/1990 | Tozer | 273/246 |
| 5,106,098 | 4/1992 | Filiczkowski | 273/246 |

*Primary Examiner*—William E. Stoll

[57] ABSTRACT

A horse racing game for simulating horse purchasing and racing. The inventive method utilizes a game board having a business track and a race track. Players move about the business track acquiring property and horses for racing on the race track. A number of regular races take place before a final roses race, after which a winner of the game is determined as the richest player.

12 Claims, 3 Drawing Sheets

HORSE RACING GAME

BACKGROUND OF THE INVENTION

1. Field of the Invention

The present invention relates to board games and more particularly pertains to a horse racing game for simulating horse purchasing and racing.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. No. 5,226,655; U.S. Pat. No. 3,690,666; U.S. Pat. No. 4,729,568; U.S. Pat. No. 4,986,546; and U.S. Pat. No. 5,149,101.

While these devices fulfill their respective, particular objectives and requirements, the aforementioned patents do not disclose a horse racing game for simulating horse purchasing and racing which utilizes a game board having a business track and a race track, wherein players move about the business track acquiring property and horses for racing on the race track, with a number of regular races taking place before a final roses race, after which a winner of the game is determined as the richest player.

In these respects, the horse racing game according to the present invention substantially departs from the conventional concepts and designs of the prior art, and in so doing provides an apparatus primarily developed for the purpose of simulating horse purchasing and racing.

SUMMARY OF THE INVENTION

In view of the foregoing disadvantages inherent in the known types of board games now present in the prior art, the present invention provides a new horse racing game construction wherein the same can be utilized for simulating horse purchasing and racing. As such, the general purpose of the present invention, which will be described subsequently in greater detail, is to provide a new horse racing game apparatus and method which has many of the advantages of the board games mentioned heretofore and many novel features that result in a horse racing game which is not anticipated, rendered obvious, suggested, or even implied by any of the prior art board games, either alone or in any combination thereof.

To attain this, the present invention generally comprises a horse racing game for simulating horse purchasing and racing. The inventive method utilizes a game board having a business track and a race track. Players move about the business track acquiring property and horses for racing on the race track. A number of regular races take place before a final roses race, after which a winner of the game is determined as the richest player.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new horse racing game apparatus and method which has many of the advantages of the board games mentioned heretofore and many novel features that result in a horse racing game which is not anticipated, rendered obvious, suggested, or even implied by any of the prior art board games, either alone or in any combination thereof.

It is another object of the present invention to provide a new horse racing game which may be easily and efficiently manufactured and marketed.

It is a further object of the present invention to provide a new horse racing game which is of a durable and reliable construction.

An even further object of the present invention is to provide a new horse racing game which is susceptible of a low cost of manufacture with regard to both materials and labor, and which accordingly is then susceptible of low prices of sale to the consuming public, thereby making such horse racing games economically available to the buying public.

Still yet another object of the present invention is to provide a new horse racing game which provides in the apparatuses and methods of the prior art some of the advantages thereof, while simultaneously overcoming some of the disadvantages normally associated therewith.

Still another object of the present invention is to provide a new horse racing game for simulating horse purchasing and racing.

Yet another object of the present invention is to provide a new horse racing game which utilizes a game board having a business track and a race track, wherein players move about the business track acquiring property and horses for racing on the race track, with a number of regular races taking place before a final roses race, after which a winner of the game is determined as the richest player.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
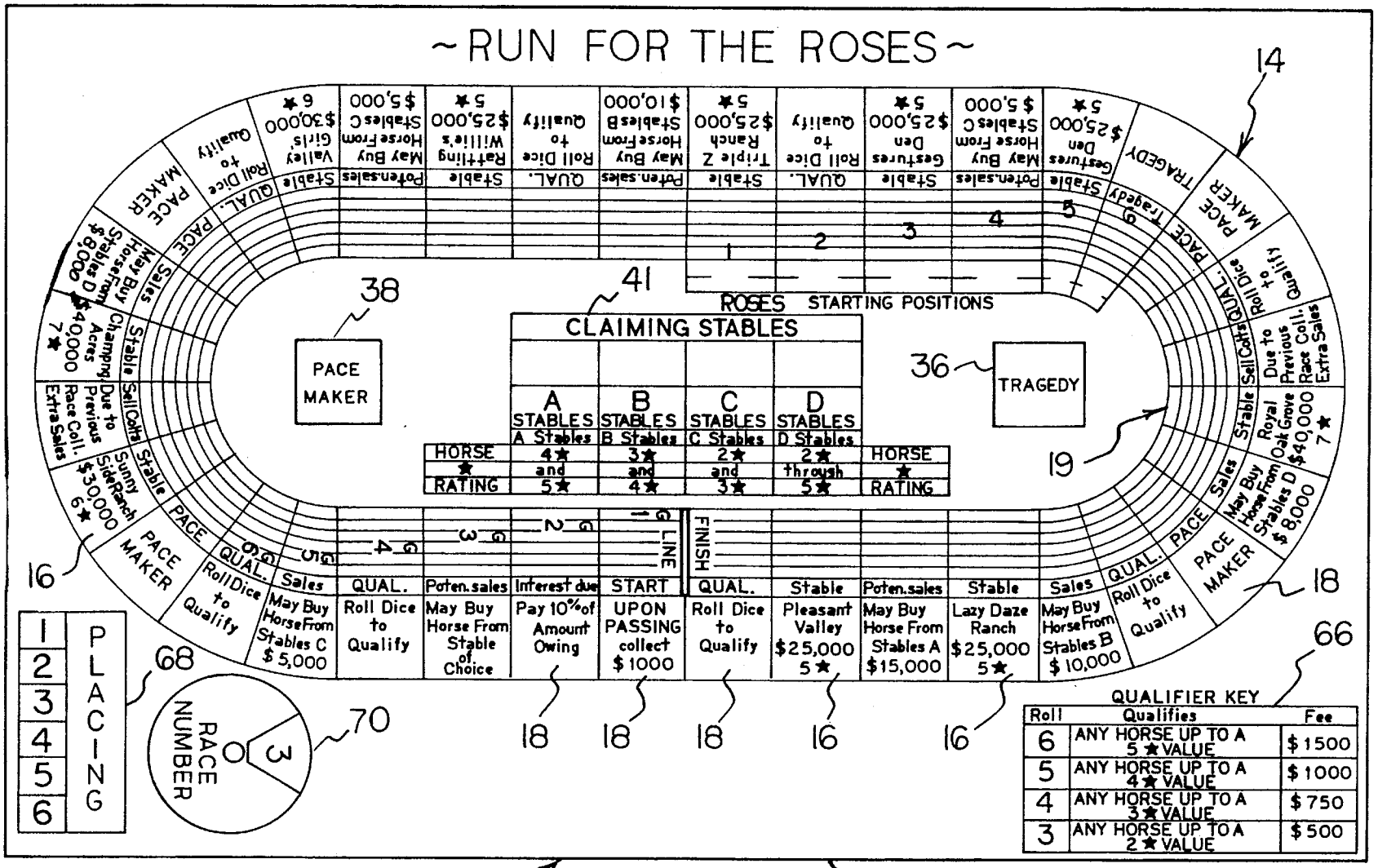
FIG. 1 is a top plan view of a horse racing game according to the present invention.

With reference now to the drawings, and in particular to FIGS. 1–5 thereof, a new horse racing game embodying the principles and concepts of the present invention and generally designated by the reference numeral 10 will be described.

More specifically, it will be noted that the horse racing game 10 comprises a game board 12 including a business track 14 having a plurality of land spaces 16 and a plurality of action spaces 18 printed thereon. A rack track 19 is defined concentrically within the business track 18 for permitting the simulated racing of horses as will be subsequently described in more detail.

Figure 2:
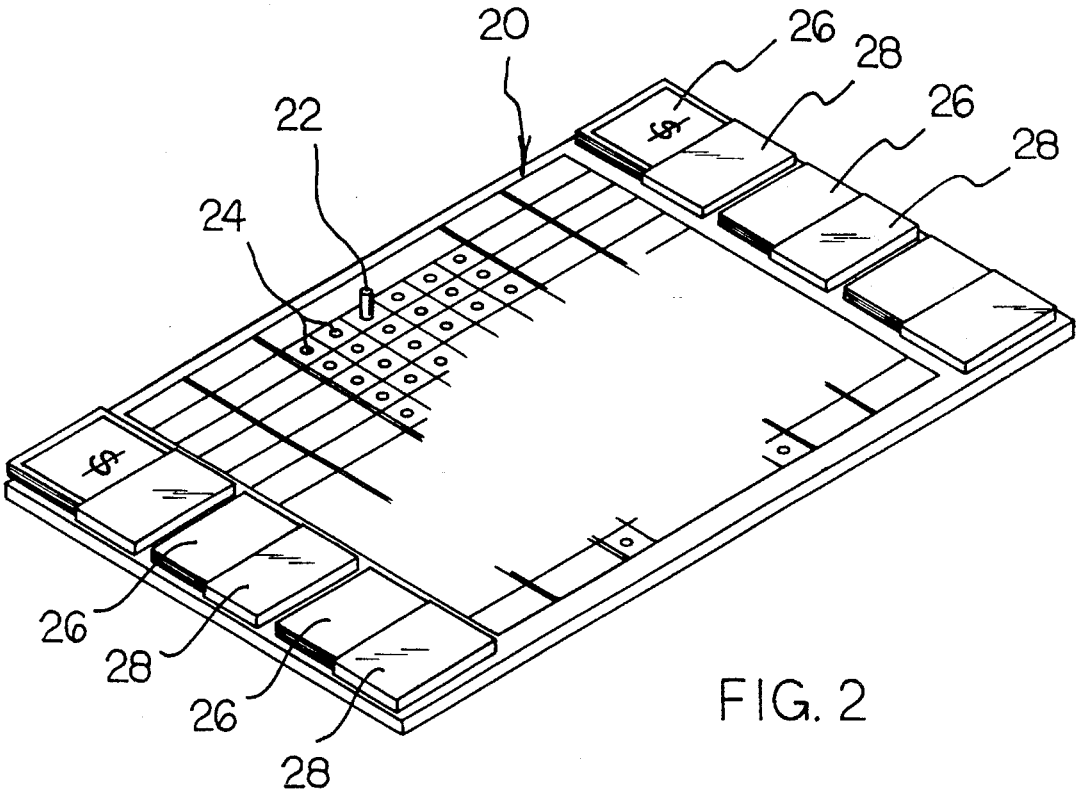
FIG. 2 is an isometric illustration of a combination debt chart and bank.

A combination debt chart and bank 20 is shown in FIG. 2 and includes one or more colored pegs which can be positioned within a matrix of holes to record an amount owed to the bank by each individual player (in accordance with a particular player color). Money 26 is stored within pockets 28 secured along opposed sides of the centrally located debt chart. The money 26 can be in denominations of 50,000; 20,000; 10,000; 5,000; 1,000; 500; 100; and 50 dollars or other units.

Figure 3:
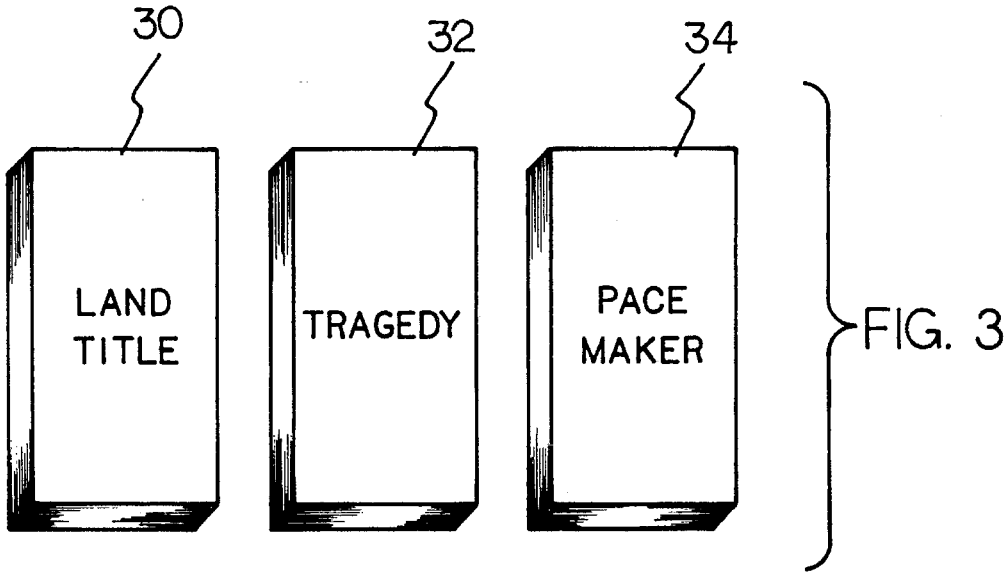
FIG. 3 is an isometric illustration of a plurality of cards for use with the present invention.
Figure 4:
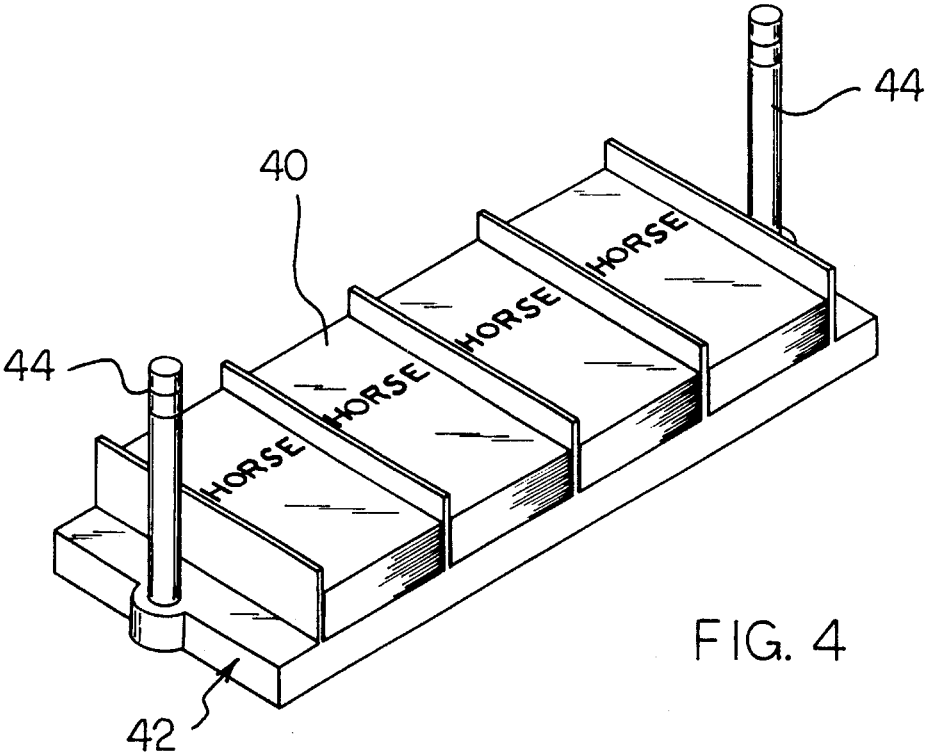
FIG. 4 is an isometric illustration of a horse card holding rack of the invention.

As shown in FIG. 3, the game 10 includes a plurality (preferably ten) of land title cards 30, a plurality (preferably 32) of tragedy cards 32, and a plurality (preferably 48) of pacemaker cards 34. The tragedy cards 32 and the pacemaker cards 34 can be positioned upon the respective tragedy area 36 and pacemaker area 38 of the game board 12, as shown in FIG. 1. A plurality of horse cards 40 are removably stored within a divided card rack 42, as shown in FIG. 4, with pencils 44 being positioned within holding apertures directed into the card rack for permitting convenient storage of the pencils.

The land title cards 30 each define a particular land space 16 on the business track 14 of the game board 12. The land spaces 16 are each assigned a purchase price, a ranking in the form of a star ranking ranging from five stars (5*) to seven stars (7*), and an extra sales list including a money amount corresponding to a placing of a horse from that particular land space in a manner which will be subsequently described in more detail. The land title cards 30 can each take the form of an unillustrated folder having the above-listed information printed inside, as well as one or more pockets for holding a horse card 40 associated with that land space 16. The folder can include a space on the inside or back which allows a player to track when a horse has been qualified for a race. Initially there are preferably six (6) land spaces 16 having a five star (5*) ranking, two (2) land spaces having a six star (6*) ranking, and two (2) land spaces having a seven star (7*) ranking.

The plurality of horse cards 40 each define a particular horse in terms of a ranking from two stars (2*) to five stars (5*) according to a price or pre-race value of the horse described thereon. The horse cards 40 thus include the ranking of the horse, the type of horse such as a mare or a stallion, a pre-race value of the horse, and an age of the horse printed thereon. The horse cards 40 are initially positioned within a claiming stables area 41 including an unlabeled stables (A) area, a stables (B) area, a stables (C) area, and a stables (D) area. The areas are segregated by the ranking of the horse cards 40 positioned therein. For example, the stables (A) area can include only four and five star horse cards 40, the stables (B) area can include only three and four star horse cards, the stables (C) area can include only two and three star horse cards, and the stables (D) area can include horse cards ranging from two through five stars. In other words, the horse cards 40 are separated into groups which satisfy the rules for assignment to the stables, with the segregated cards being positioned into the respective stables within the claiming stables area 41.

Figure 5:
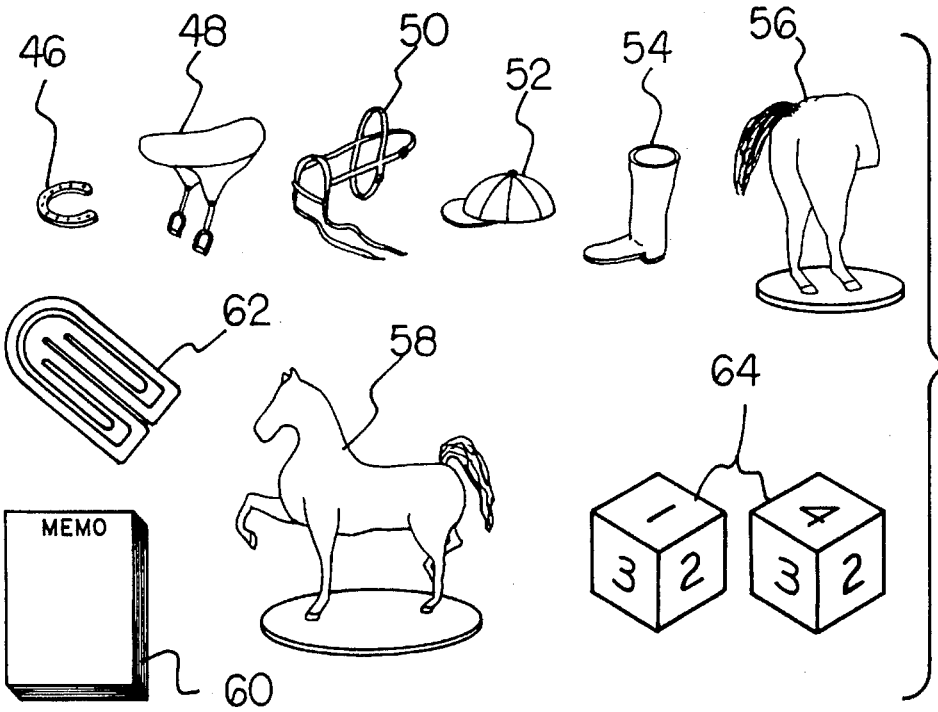
FIG. 5 is an isometric illustration of a plurality of auxiliary game components of the invention.

The game 10 further includes six player tokens which can resemble a horse shoe 46, a saddle 48, a bridle 50, a hat 52, a boot 54, and a back half of a horse 56, as shown in FIG. 5 for example. These tokens are to be utilized on the business track 18 of the game board 12. A plurality of race horse pieces 58 are included for positioning upon the race track 19 of the board 12, and are provided in a plurality of colors for identification thereof relative to a particular player.

A note or memo pad 60, as shown in FIG. 5, is provided which allows an individual player to easily tally a net worth of that by player through a manual addition of assets and subtraction of debt as will be subsequently described in more detail. A plurality of post-race holders each in the form of a colored clip 62 corresponding to a color of a particular race horse piece 58 can be provided for storing horse cards subsequent to racing thereof. Lastly, a pair of dice 64 are included an are configured such that opposite pips of each die include: a one (1) opposite a four (4), a two (2) opposite a two (2), and a three (3) opposite a three (3).

If desired, an unillustrated pay-out chart can be printed in an interior surface of an unillustrated box cover to permit for ease of calculating the pay out for a particular horse. The pay-out chart includes columns listing a placing of the horse, and rows listing the dollar value, with intersecting columns and rows including a particular pay-out amount in accordance with the following pay-out formulas:

First place pay-out=(3) times the pre-race value.

Second place pay-out=(2) times the pre-race value.

Third place pay-out=(1.5) times the pre-race value.

Fourth place pay-out=(1) times the pre-race value.

Fifth place pay-out=(0.5) times the pre-race value.

Sixth place pay-out=(0).

With these components of the game 10, a method of playing the game can be accomplished by initially giving each player a five star (5*) piece of land by giving each player an initial land title card 30 having a five star ranking, a horse card 40 from stables (C), 35,000 dollars from the bank 20, and one of the player tokens 46–56. The players can each choose the initial land title card 30 from the bank by first rolling the dice to establish a player order from highest to lowest, with the players then each selecting an individual one of the land spaces 16, as desired, in the player order. Simultaneously, each player selects a horse card 40 from stables (C). A player should be assigned the task of banker, which can be done by rolling the dice 64. Players may then roll the dice 64 again, with a highest number rolled determining a starting player of the game.

The players then proceed to move their respective player tokens 46–56 a number of spaces in a counter-clockwise direction about the board in accordance with a number generated during a rolling of the dice 64. As the players move about the business track, each player: purchases land when residing on a land space 16, draws a tragedy card 32 or a pacemaker card 34 when residing on an action space 18 indicating such, or performs another action indicated on the action space. The players must each attempt to qualify their horses during this period of play.

To qualify a horse, the player must land on an action space 18 indicating that the player may roll the dice to qualify. Alternatively, the player may draw one of the pacemaker cards 34 indicating that they may qualify. Further, if the player resides on a land space 16 which the player already owns, the player may try to qualify a horse from this piece of land only. Subsequent to being able to qualify, an initial roll of the dice will decide which ranking of horse may be qualified in accordance with a qualifier key table 66 printed on the game board 12. The key table indicates the ranking of horse and the fee associated with such qualifying of the horse. The player must pay the associated fee to the bank and position a respective one of the race horse pieces 58 onto the race track 19 at the sequentially oriented starting gates from gate number one (G1) which is on track number one, to gate number six (G6) which is on track number six.

Upon a qualification of six horses on the race track 19, the player qualifying the sixth horse is permitted: to select a player as a dice roller for this particular race, designate a player to move the race horse pieces 58 about the race track 19; to make the first move on the business track after this race is over and all pay-outs are complete.

It should be noted that each land title card 30 allows a player to race at least one horse card 40, with a plurality of horse cards also being able to be raced therefrom. In the case of a plurality of horse cards 40 being raced from a single land title card 30, the combined ranking of the horses cannot exceed the ranking of the land title card 30. For example, a seven star (7*) land title card 30 can race a three star horse card and a four star horse card together, a five star horse card and a two star horse card together, or a three star horse card and another three star horse card together. The seven star (7*) land title card 30 could not race a five star horse card and a three star horse card together.

To initiate the one-lap regular race after qualification of the sixth horse card 40, the dice are rolled separately for each of all six race horse pieces, starting from the race horse piece positioned on track number one through to track number six to define a set of rolls of the dice. The corresponding race horse piece for a particular roll of the dice 64 is advanced a corresponding number of spaces in a predetermined direction about the race track 19. Should the player roll the same number on both die of the dice 64, referred to as doubles, the player's race horse piece would move ahead the sum of such numbers and the player would be allowed to roll one of the dice another time. Should a player roll a one (1) on each of the dice, the player is permitted to again roll both dice without limit to the number of times that such double ones (1) can occur.

Only after completion of a set of rolls, and the passage of at least one horse past a finish line marked on the race track 19 of the game board 12 can a winner of a particular regular race be determined. All horses not past the finish line will continue to race the regular race until the horse have past the finish line. As the horse cards 40 are declared winners, the respective race horse piece 58 is positioned into a placing table 68 printed on the game board 12. A race number indicator dial 70 can be mounted to the game board 12 to facilitate tracking of the number of races completed. If two race horse pieces 58 have crossed the finish line and are both positioned on a single space of the race track 19, a photo finish is declared wherein the dice 64 are again rolled to break the tie. The race horse pieces 58 are advanced to determine a winner. However, the race horse pieces 58 involved in the photo finish cannot surpass another race horse piece 58 not involved in the photo finish. Pay-outs are then made in accordance with the race horse piece's 58 final position and ranking as listed within the aforementioned pay-out table or by the following pay-out formulas:

First place pay-out=(3) times the pre-race value.

Second place pay-out=(2) times the pre-race value.

Third place pay-out=(1.5) times the pre-race value.

Fourth place pay-out=(1) times the pre-race value.

Fifth place pay-out=(0.5) times the pre-race value.

Sixth place pay-out=(0).

The pay-outs are awarded to the corresponding player and such is noted on the corresponding horse card 40 with the pencil 44. The winnings of each horse card 40 is considered the horse card's post-race value, which can be recorded on a bottom of the respective horse card. Subsequent to a race, the raced horse card 40 is then removed and secured within one of the post-race holders of colored clips 62.

After the race, players direct their attention back to the business track 14 wherein player again attempt to qualify additional horse cards 40 for another race until a number of players qualify for the roses race. Qualification for the roses race may take place simultaneously during continued play of the game. However, a horse card 40 can only be qualified for either a regular race or a roses race, not both during each particular turn.

To borrow money during the game, a player may remove a predetermined amount of money from the bank 20 and repay when able an amount of money equal to (1.5) times the amount borrowed. Players may be fined 1000.00 dollars for failing to replace the pencils 44 back into the card rack 42. Players must erase the placing of each previous race from the land title card 30. If the player does not erase the placing from a previous race and lands on an action space 18 having "extra sales", the player is fined 1000.00 dollars.

During movement of the player tokens 46–56 about the business track, players will land on action spaces 18 directing the drawing of a tragedy card 32 or a pacemaker card 34. The tragedy cards 32 negatively affect a player's position in the game. For example, the tragedy cards 32 may read: "Bad news, one of your horses breaks its leg and must be destroyed. You must eliminate one of your horses that you currently own.", "Rented a horse on a cash rental basis. The horse never wins. You lose $2500.00 on that business excursion.", "Bank requires money on principal. You must knock your loan down by $5000.00. This costs you $7500.00.", etc. In contrast, the pacemaker cards 34 positively affect a player's position in the game. For example, the pacemaker cards 34 may read: "Advance to the Triple ZZZ ranch.", "Move horse up one space.", "You may roll the dice to qualify.", "You may claim an unqualified horse of up to five star ranking from any player for the pre-race value.", etc. Thus, the tragedy cards 32 and the pacemaker cards 34 add an additional element of chance to the game as a player acts on the directions contained therein.

Regarding a sale of any assets during play of the game, any land title cards 30 or horse cards 40 that are sold will be traded at one-half the purchase value or pre-race value. Whenever a player lands on an action space 18 of the business track 14 marked "extra sales", the player again receives a designated amount of cash, which is written on each land title 30, depending upon the placing of the horse/horses, and the value of the land title/titles 30 from which the horse card or cards 40 were most recently raced in a regular race, as the better a horse card 40 does on the track, the greater the sales of the breeders.

Only when a player has a post-race value for both a mare and a stallion, and when the player has an un-raced horse card 40 which is three-years of age and eligible for qualification, can the player enter or attempt to qualify for the roses race. Only three-year old horse cards 40 can be raced within the roses race. A roses pre-race value can be computed by the following formula:

Roses pre-race value=pre-race value of three-year old horse card+post-race value of a mare+post-race value of a stallion.

The horse cards 40 for the roses race are qualified as set forth above for the regular race. As the horse cards 40 are qualified, a corresponding race horse piece is positioned in the roses starting positions at the upper right portion of the race track 19 of the game board 12. After a sixth horse card 40 has been qualified, all horse cards having corresponding horse pieces positioned upon the race track and all un-raced horse cards 40 will be sold to the bank at one-half (½) the pre-race value and removed from play. Post-race values of horses that have already been raced and not used for the roses pre-race value are worth nothing when totalling assets of a particular player.

The one-and-a-half lap roses race is run in accordance with the procedure set forth above for the regular races and pay-outs are computed using the pay-out table or the pay-out formulas listed above with the roses pre-race value. After the roses race, the game is over, the players total their net worth, and the player having the greatest net worth is considered a winner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A horse racing game method comprising the steps of:

(a) providing a game apparatus including a game board having a business track having a plurality of land spaces and a plurality of action spaces printed thereon, and a race track defined concentrically within the business track for permitting the simulated racing of horses;

(b) providing a bank having money;

(c) providing a plurality of land title cards, the land title cards each defining a particular land space on the business track of the game board;

(d) providing a plurality of horse cards, the plurality of horse cards each defining a particular horse as a type of horse being either a mare or a stallion, a pre-race value of the horse, an age of the horse, and a ranking of the horse;

(e) providing a plurality of disparate player tokens, for positioning upon the business track of the game board;

(f) providing a plurality of race horse pieces for positioning upon the race track of the game board;

(g) providing a pair of dice;

(h) initially giving each player a land title card, a horse card, and a predetermined amount of money from the bank, and an individual one of the player tokens;

(i) selecting a player order;

(j) rolling the dice by a player in the player order;

(k) moving a respective player token in a predetermined direction about the business track of the board in accordance with a number generated during a rolling of the dice;

(l) permitting the player to purchase land when residing on a land space and permitting the player to purchase a horse card when residing on an action space which allows a player to purchase a horse;

(m) attempting to qualify a horse by the player, wherein the player must land on an action space indicating that the player can roll the dice to qualify;

(n) rolling the dice by the player to determine which horse card can be qualified;

(o) paying a fee by the player to qualify the horse;

(p) positioning a respective one of the race horse pieces corresponding to the horse card onto the race track;

(q) repeating steps (j) through (p) until six horse cards have been qualified and six horse pieces are positioned on the race track;

(r) rolling the dice separately for each of all six race horse pieces, starting from the race horse piece positioned on a track number one through to a track number six of the race track to define a set of rolls of the dice;

(s) advancing a race horse piece for a particular roll of the dice a corresponding number of spaces in a predetermined direction about the race track;

(t) repeating steps (r) and (s) until after a completion of a set of rolls, and a passage of at least one horse past a finish line marked on the race track of the game board; then repeating sets of rolls until all positions of the horses in each race have been finalized;

(u) determining a winner as the player with a horse piece first to pass the finish line, as well as determining the remaining horses finishing positions 1st through 6th as they pass the finish line.

2. The horse racing game method of claim 1, and further comprising the steps of:

(v) determining a pay-out value by the following pay-out formulas:
First place pay-out=(3) times the pre-race value;
Second place pay-out=(2) times the pre-race value;
Third place pay-out=(1.5) times the pre-race value;
Fourth place pay-out=(1) times the pre-race value;
Fifth place pay-out=(0.5) times the pre-race value;
Sixth place pay-out=(0);

(w) awarding the pay-outs to the corresponding player;

(x) determining post-race value equal to the pay-out only.

3. The horse racing game method of claim 2, wherein steps (j) through (p) are repeated until six horse cards have been qualified for a roses race and six horse pieces are positioned on the race track in a roses starting position.

4. The horse racing game method of claim 3, wherein only when a player has a post-race value for both a mare and a stallion, and when the player has an un-raced horse card which is of a predetermined age can the player attempt to qualify for the roses race.

5. The horse racing game method of claim 4, wherein the horse cards for the roses race are qualified as set forth in steps (m) through (p).

6. The horse racing game method of claim 5, wherein the roses race is run as set forth in steps (r) through (u).

7. The horse racing game method of claim 6, wherein the game is over after the roses race, the players total their net worth, and the player having the greatest net worth is considered a winner.

8. The horse racing game method of claim 7, wherein the land spaces are each assigned a purchase price, a ranking in the form of a star ranking ranging from five stars (5*) to seven stars (7*).

9. The horse racing game of claim 8, wherein the ranking of each horse ranges from two stars (2*) to five stars (5*) according to a pre-race value of a horse described on a respective one of the horse cards.

10. The horse racing game method of claim 9, wherein each player can choose the respective initial land title card from the bank in a predetermined order determined by rolling the dice by each player to establish a player order from highest to lowest, with the players then each selecting an individual one of the land title cards in the player order.

11. The horse racing game method of claim 10, wherein each player selects a horse card simultaneously along with a selection of the land title card.

12. The horse racing game method of claim 11, and further comprising a plurality of tragedy cards, and a plurality of pacemaker cards, with a number of the actions spaces instructing a player to draw either of the tragedy cards and the pacemaker cards.

* * * * *